US008627578B1

(12) United States Patent
Gibson

(10) Patent No.: US 8,627,578 B1
(45) Date of Patent: Jan. 14, 2014

(54) HOODED DRYER ACCESSORY SYSTEM

(76) Inventor: Amie L. Gibson, Grand Bay, AL (US)

( * ) Notice: Subject to any disclaimer, the term of this patent is extended or adjusted under 35 U.S.C. 154(b) by 69 days.

(21) Appl. No.: 13/242,998

(22) Filed: Sep. 23, 2011

(51) Int. Cl.
*A45D 20/18* (2006.01)

(52) U.S. Cl.
USPC ..... 34/99; 34/96

(58) Field of Classification Search
USPC ..... 34/96–99; 4/520; D2/883; D28/10, 19, D28/18
See application file for complete search history.

(56) References Cited

U.S. PATENT DOCUMENTS

| | | | | | |
|---|---|---|---|---|---|
| 1,707,554 | A | * | 4/1929 | Hendry | 34/283 |
| 1,764,912 | A | * | 6/1930 | Bessie Caster-Udell | 2/174 |
| 2,261,248 | A | * | 11/1941 | Graham | 34/90 |
| 2,290,455 | A | * | 7/1942 | Cook | 34/99 |
| 2,295,820 | A | * | 9/1942 | Wright | 34/99 |
| 2,446,790 | A | * | 8/1948 | Scola | 34/90 |
| 2,453,364 | A | | 11/1948 | Fears | |
| 2,832,157 | A | * | 4/1958 | Hudson | 34/90 |
| 2,996,724 | A | * | 8/1961 | Rose et al. | 2/171 |
| 3,043,016 | A | * | 7/1962 | Miller | 34/99 |
| 4,934,068 | A | * | 6/1990 | Curlee | 34/99 |
| 5,029,404 | A | | 7/1991 | Terrell | |
| 5,088,126 | A | * | 2/1992 | Mathis | 2/181 |
| 5,218,772 | A | * | 6/1993 | Dickson, Sr. | 34/99 |
| 5,313,668 | A | * | 5/1994 | Bogan et al. | 2/181.4 |
| 5,673,494 | A | * | 10/1997 | Pham | 34/96 |
| 5,845,654 | A | * | 12/1998 | Johnson | 132/210 |
| 5,887,357 | A | * | 3/1999 | McNair | 34/99 |
| 6,049,994 | A | | 4/2000 | Pickett | |
| D424,239 | S | | 5/2000 | Key | |
| D435,699 | S | * | 12/2000 | Mowry | D29/102 |
| D549,872 | S | | 8/2007 | Gordon | |
| 2006/0143787 | A1 | * | 7/2006 | Echols | 2/181 |
| 2008/0168594 | A1 | * | 7/2008 | Bratton | 2/174 |
| 2010/0132088 | A1 | * | 6/2010 | Bloom et al. | 2/49.1 |
| 2012/0278968 | A1 | * | 11/2012 | Bowens | 2/171.2 |

OTHER PUBLICATIONS

Extended Liner Tapes Technical Data Sheet, (3M) Sep. 2008, [Product Catalog Data Sheet online], [retrieved on Jan. 24, 2013]. Retrieved from 3M Adhesive Transfer Tape Extended Liner 450EK Product Catalog using internet <URL: http://multimedia.3m.com/mws/mediawebserver?mwsld=SSSSSufSevTsZxtU48_G48tUevUgevTSevTSevTSeSSSSSS—&fn=Extended_Liner_7038439.pdf>.*

* cited by examiner

*Primary Examiner* — Kenneth Rinehart
*Assistant Examiner* — Sharla Magana

(57) ABSTRACT

A hooded dryer accessory system having a panel with a first end and a second end, the panel is generally flexible, the panel is arc shaped wherein a top edge has an arc length greater than that of a bottom edge, a first half connecting means on the first end of the panel and a second half connecting means on the second end of the panel, wherein the first half connecting means temporarily engages the second half connecting means, and a padding component on a back surface of the panel along all or a portion of the bottom edge.

1 Claim, 3 Drawing Sheets

(In-use View)

(Top View)

(Back View)

(Cross-sectional View)

(In-use View)

(In-use View)

HOODED DRYER ACCESSORY SYSTEM

FIELD OF THE INVENTION

The present invention is directed to an accessory for a hooded dryer, more particularly to a strap-like system for wrapping around a user's hairline and using with a hooded dryer.

BACKGROUND OF THE INVENTION

Hooded dryers can be uncomfortable for some individuals. For example, some users may become overheated (or their jewelry may become overheated and subsequently burn their skin) or some users may have difficulty hearing or breathing. The present invention features a hooded dryer accessory system. The present invention is worn around the user's hairline and encloses the bottom of the hooded dryer. The system helps push the heat back up in to the dryer, keeping user cooler, drying hair faster, and protecting the user's face, neck, ears, and body from the heat of the dryer.

SUMMARY

The present invention features a hooded dryer accessory system. In some embodiments, the hooded dryer accessory system comprises a panel having a first end and a second end, the panel is generally flexible, the panel is arc shaped wherein a top edge has an arc length greater than that of a bottom edge; a first half connecting means disposed on the first end of the panel and a second half connecting means disposed on the second end of the panel, wherein the first half connecting means temporarily engages the second half connecting means: and a padding component disposed on a back surface of the panel along all or a portion of the bottom edge.

In some embodiments, the connecting means comprises a hook-and-loop fastener mechanism, a magnet mechanism, a hook mechanism, a snap mechanism, a button mechanism, an adhesive mechanism, a clip mechanism, a tie mechanism, or a combination thereof.

In some embodiments, the first half connecting means is disposed on a front surface of the panel at the first end, and the second half connecting means is disposed on the back surface of the panel at the second end.

In some embodiments, the padding component is attached to the back surface of the panel along all or a portion of the bottom edge via stitching. In some embodiments, the padding component is attached to the back surface of the panel along all or a portion of the bottom edge via an adhesive. In some embodiments, the adhesive is adapted to withstand temperatures up to about 150 degrees Fahrenheit.

In some embodiments, the system further comprises a hooded dryer, wherein the top edge of the panel is wrapped around a bottom edge of the hooded dryer and the front surface of the panel faces outwardly away from the hooded dryer.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
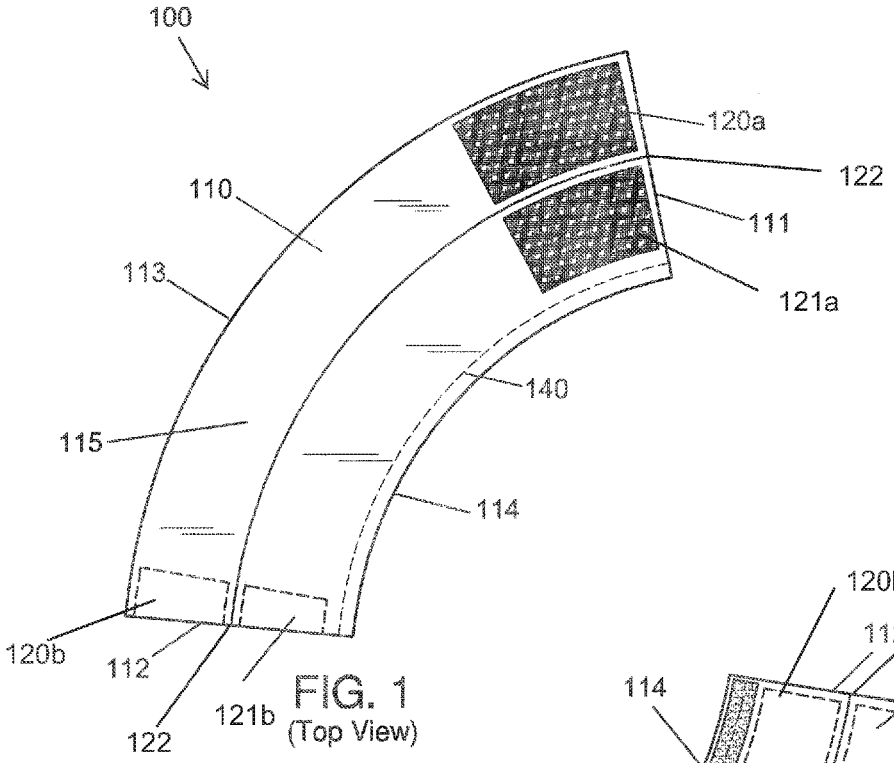
FIG. 1 is a front view of the system of the present invention.
Figure 2:
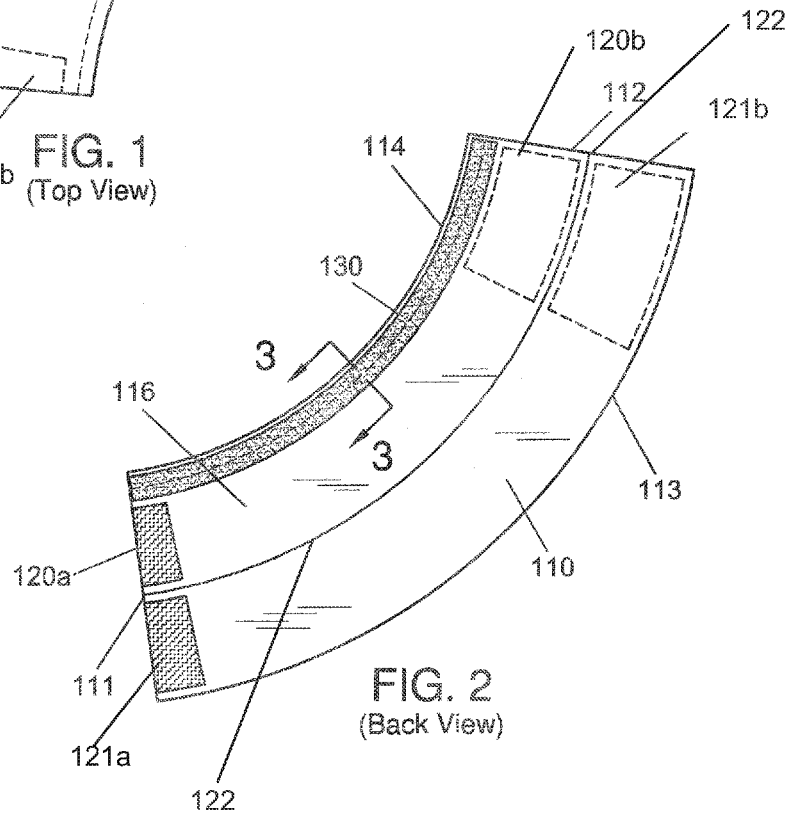
FIG. 2 is a back view of the system of the present invention.

Referring now to FIG. 1-5, the present invention features a hooded dryer accessory system 100. The system 100 comprises a panel 110 (e.g., strap) having a first end 111, a second end 112, a top edge 113, a bottom edge 114, a front surface 115, and a back surface 116. In some embodiments, the panel 110 is arc shaped as shown in FIG. 1 and FIG. 2. For example, in some embodiments, the top edge 113 has an arc length that is larger than that of the bottom edge 114.

The panel 110 is generally flexible and durable which can be disposable or reusable. The panel 110 may be constructed from a variety of materials. For example, in some embodiments, the panel 110 is constructed from a material comprising polyethylene, cotton, nylon, elastane, cardboard, posterboard, any other appropriate material, or a combination thereof.

The first end 111 can be temporarily connected to the second end 112 via a connecting means. The connecting means may be any appropriate connecting means including but not limited to a hook-and-loop fastener mechanism. For example, a first half connecting means 120*a* is disposed on the first end 111 and a second half connecting means 120*b* is disposed on the second end 112, wherein the first half connecting means 120*a* can temporarily engage the second half connecting means 120*b*. In addition, a third half connecting means 121*a* is disposed on the first end 111 and a fourth half connecting means 121*b* is disposed on the second end 112, wherein the third half connecting means 121*a* can temporarily engage the fourth half connecting means 121*b*. Along the length of the panel 110 is an interior region 122 which has no hook-and-loop fasteners. At the first end 111, the interior region 122 separates the first half connecting means 120*a* and the third half connecting means 121*a*. At the second end 112, the interior region 122 separates the second half connecting means 120 and the fourth half connecting means 121*b*.

Figure 4:
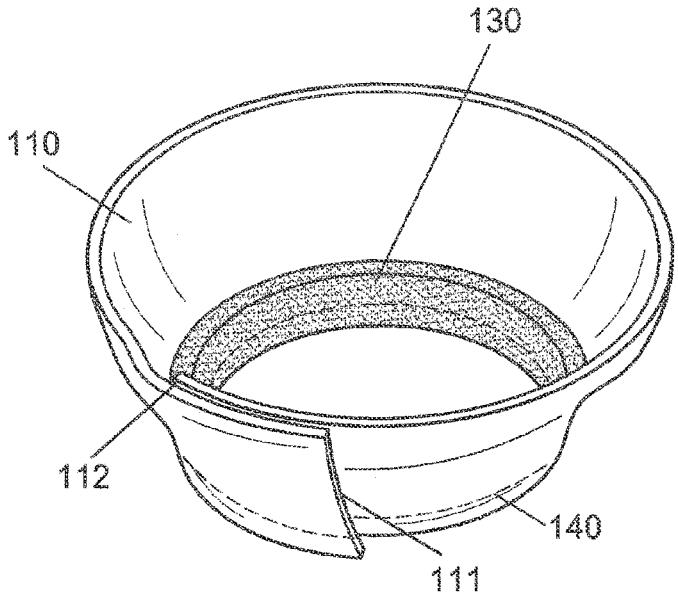
FIG. 4 is an in-use view of the system of the present invention.

In some embodiments, the first half connecting means 120*a* is disposed on the front surface 115 of the panel 110 at the first end 111, and the second half connecting means 120*b* is disposed on the back surface 116 of the panel 110 at the second end 112. FIG. 4 shows the first end 111 and the second end 112 connected together, wherein the ends 111, 112 overlap.

As shown in FIG. 2, in some embodiments, a padding component 130 is disposed on the panel 110. For example, the padding component 130 may be disposed on the back surface 116 of the panel 110 along all or a portion of the bottom edge 114.

Figure 3:
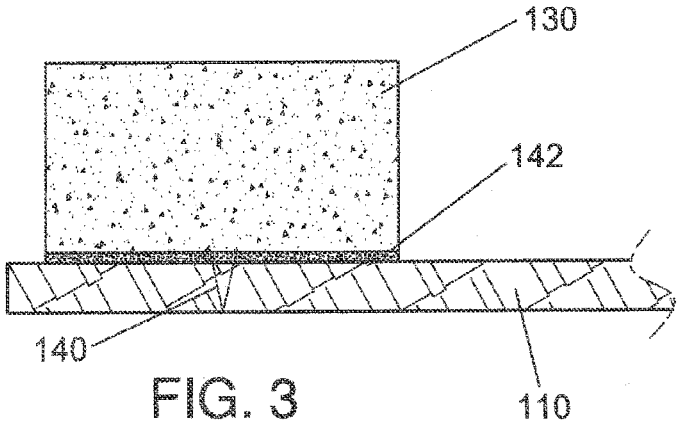
FIG. 3 is a cross sectional view of the system of the present invention.

As shown in FIG. 3, in some embodiments, the padding component 130 may be attached to the panel 110 (e.g., the back surface 116 of the panel 110 along all or a portion of the bottom edge 114) via stitching 140. In some embodiments, the padding component 130 may be attached to the panel 110 (e.g., the back surface 116 of the panel 110 along all or a portion of the bottom edge 114) via an adhesive 142. The adhesive 142 may be adapted to withstand high temperatures, for example temperatures up to about 120 degrees Fahrenheit, temperatures up to about 130 degrees Fahrenheit, temperatures up to about 140 degrees Fahrenheit, temperatures up to about 150 degrees Fahrenheit, etc. The attachment of the padding component 130 to the panel 110 is not limited to the aforementioned mechanisms.

Figure 5:
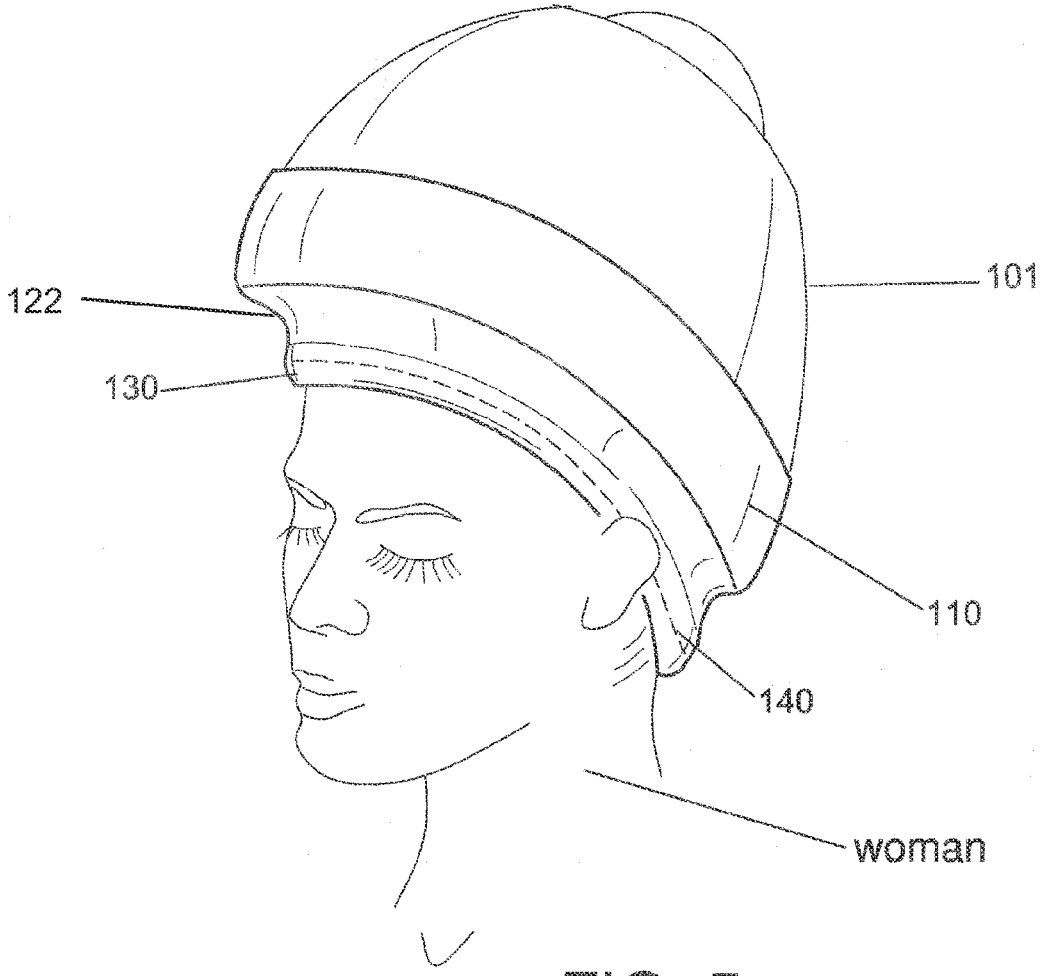
FIG. 5 is an in-use view of the system of the present invention.

As shown in FIG. 5, the panel 110 is worn around the hairline of the user and is secured via the connecting means. The padding component 130 contacts the user's head, and the front surface 115 of the panel 110 faces outwardly. The top edge 113 of the panel 110 is wrapped around the bottom edge of the hooded dryer 101, so that the flexible interior region 122 of the panel 110 can bend inwardly from the hood of the dryer 101 to the user's head. The system 100 can prevent the hot air of the hooded dryer 101 from contacting the user's ears, face, neck, and body. In some embodiments, the system 100 includes the hooded dryer 101, or a bottom edge of a hooded dryer 101.

The system 100 may be constructed in a variety of sizes, styles, and designs. For example, in some embodiments, the bottom edge 114 of the panel 110 has an arc length between about 15 to 20 inches. In some embodiments, the bottom edge 114 of the panel 110 has an arc length between about 20 to 25 inches. In some embodiments, the bottom edge 114 of the panel 110 has an arc length between about 25 to 30 inches. In some embodiments, the bottom edge 114 of the panel 110 has an arc length between about 30 to 35 inches. In some embodiments, the bottom edge 114 of the panel 110 has an arc length between about 35 to 40 inches. The system 100 is not limited to the aforementioned dimensions.

As used herein, the term "about" refers to plus or minus 10% of the referenced number. For example, an embodiment wherein the arc length of the bottom edge 114 is about 20 inches includes an arc length that is between 18 and 22 inches.

The disclosures of the following U.S. Patents are incorporated in their entirety by reference herein: U.S. Pat. No. 2,453,364; U.S. Pat. No. 3,043,016; U.S. Pat. No. 5,029,404; U.S. Pat. No. 5,887,357; U.S. Pat. No. 6,049,994; U.S. Design Pat. No. D424239; U.S. Design Pat. No. D549872.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A hooded dryer accessory system (100) consisting of:

(a) a panel (110) having a first end (111) and a second end (112) and an interior region (122) disposed along the length of the panel (110), the panel (110) is generally flexible, the panel (110) is arc shaped wherein a top edge (113) has an arc length greater than that of a bottom edge (114);

(b) a first half connecting means (120*a*) disposed on the first end (111) of the panel (110) and a second half connecting means (120*b*) disposed on the second end (112) of the panel (110), wherein the first half connecting means (120*a*) temporarily engages the second half connecting means (120*b*); a third half connecting means (121*a*) disposed on the first end (111) and a fourth half connecting means (121*b*) disposed on the second end (112), wherein the third half connecting means (121*a*) temporarily engages the fourth half connecting means (121*b*); wherein the connecting means (120*a*), (120*b*), (121*a*) and (121*b*) comprise a hook-and-loop fastener mechanism; wherein the interior region (122) has no hook-and-loop fasteners and separates the first half connecting means (120*a*) and the third half connecting means (121*a*) at the first end (111) and also separates the second half connecting means (120*b*) and the fourth half connecting means (121*b*) at the second end (112);

(c) a padding component (130) disposed on a back surface (6) of the panel (110) along all or a portion of the bottom edge (114); and (d) a hooded dryer (101), wherein the top edge (113) of the panel (110) is wrapped around a bottom edge of the hooded dryer (101), so that the flexible interior region (122) of the panel (110) can bend inwardly from a hood of the dryer (101) to a user's head and the front surface (114) of the panel (110) faces outwardly away from the hooded dryer (101).

* * * * *